US012016454B2

(12) United States Patent
Medanich

(10) Patent No.: US 12,016,454 B2
(45) **Date of Patent: *Jun. 25, 2024**

(54) TABLE WITH EXPANDING TOP SURFACE

(71) Applicant: Coronado Casuals Inc., Avon, IN (US)

(72) Inventor: Frederick Medanich, Avon, IN (US)

(73) Assignee: Coronado Casuals, Inc., Avon, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/855,835

(22) Filed: Jul. 1, 2022

(65) Prior Publication Data

US 2022/0330689 A1 Oct. 20, 2022

Related U.S. Application Data

(63) Continuation of application No. 17/195,364, filed on Mar. 8, 2021, now Pat. No. 11,406,178.

(51) Int. Cl.

| | |
|---|---|
| ***A47B 1/08*** | (2006.01) |
| ***A47B 1/10*** | (2006.01) |
| ***A47B 37/00*** | (2006.01) |
| *A63D 15/04* | (2006.01) |
| *A63F 1/06* | (2006.01) |
| *A63F 3/00* | (2006.01) |
| *A63F 7/00* | (2006.01) |

(52) U.S. Cl.

CPC ..... *A47B 1/08* (2013.01); *A47B 1/10* (2013.01); *A47B 37/00* (2013.01); *A63D 15/04* (2013.01); *A63F 1/067* (2013.01); *A63F 3/00895* (2013.01); *A63F 2003/0099* (2013.01); *A63F 7/0005* (2013.01)

(58) Field of Classification Search

CPC .... A47B 1/04; A47B 1/08; A47B 1/10; A47B 2001/085; A47B 37/00; A63D 15/04; A63F 1/067; A63F 3/00895; A63F 2003/0099; A63F 7/0005

See application file for complete search history.

(56) References Cited

U.S. PATENT DOCUMENTS

| | | | | |
|---|---|---|---|---|
| 3,916,802 | A | 11/1975 | Virtue | |
| 4,345,758 | A | 8/1982 | Kempf | |
| 5,290,058 | A | 3/1994 | Adams | |
| 6,347,831 | B1 | 2/2002 | Nye | |
| 10,107,502 | B2 | 10/2018 | Mueller et al. | |
| 10,568,414 | B1 | 2/2020 | Glattstein | |
| 2011/0081104 | A1* | 4/2011 | Chiang | A47B 88/487 384/19 |
| 2012/0048150 | A1 | 3/2012 | Moore | |
| 2015/0028545 | A1 | 1/2015 | Mccrory | |
| 2015/0038206 | A1 | 2/2015 | Walton | |
| 2018/0344023 | A1 | 12/2018 | Andersson | |
| 2020/0009325 | A1 | 1/2020 | Mansson | |

FOREIGN PATENT DOCUMENTS

| | | | |
|---|---|---|---|
| DE | 9409701 | U1 | 9/1994 |

* cited by examiner

*Primary Examiner* — Matthew W Ing

(74) *Attorney, Agent, or Firm* — Ice Miller LLP

(57) ABSTRACT

A table comprising an upper surface and a lower surface attached to the upper surface via an attachment, such as a drawer slide that may freely allow motion of the upper surface, at least one table support attached to the lower surface, and at least one table support attached to the upper surface.

15 Claims, 12 Drawing Sheets

TABLE WITH EXPANDING TOP SURFACE

CROSS-REFERENCE TO RELATED APPLICATION

This application is a continuation of U.S. application Ser. No. 17/195,364 filed on Mar. 8, 2021, which is hereby incorporated by reference in its entirety.

TECHNICAL FIELD

The presently disclosed embodiments generally relate to tables and, more specifically, to a table with an expanding top surface.

BACKGROUND

Tables are available in many sizes and shapes, and may be designed for many purposes. For example, most homes have at least one dining table disposed therein. Other types of tables may be designed for a more specific use, such as any of a number of game tables (to name just one non-limiting example). A game table has a top surface that is specifically adapted for the play of one or more games. While such tables are popular, they consume a not insignificant amount of floor space and therefore it may not be practical or even feasible to include a game table in some spaces. There therefore exists a need to provide multiple types of tables within a space while minimizing the amount of floor space consumed thereby. Additionally, it may be adequate to have a table of a first size in a room under normal circumstances, but at other times it may be desirable to have a table of a second, larger, size in the room, such as when entertaining guests. The presently disclosed embodiments are directed toward meeting these needs.

SUMMARY

The presently disclosed embodiments include a table. In at least one embodiment, such a table comprises an upper surface comprising a first end, a lower surface bounded by an outer edge, surrounding the lower surface, a table apron comprising a first end, at least one table support means connected to the lower surface, and a slidable attachment means, wherein the table apron extends from the outer edge of the lower surface, away from the lower surface towards the upper surface, wherein the first end of the upper surface is coupled to the slidable attachment means, wherein the table apron is coupled to the slidable attachment means above the lower surface, and wherein the upper surface adjusts about the slidable attachment means between an open position and a closed position. In an aspect of such an embodiment, the table further comprises at least one upper surface support means connected to the upper surface. In an aspect of such an embodiment, the upper surface adjusts about the slidable attachment means between an open position and a closed position. In an aspect of such an embodiment, when the table is in the closed position, the lower surface is concealed by the upper surface. In an aspect of such an embodiment, when the table is in the open position, the lower surface is exposed. In an aspect of such an embodiment, the lower surface comprises a gaming surface. In an aspect of such an embodiment wherein the gaming surface comprises a surface for playing shuffleboard, table pool, card games, or board games, to name just a few non-limiting examples.

In at least one embodiment, such a table comprises an upper surface comprising a first end, a lower surface bounded by an outer edge, surrounding the lower surface, a table apron comprising a first end. at least one table support means connected to the lower surface, and a slidable attachment means, wherein the table apron extends from the outer edge of the lower surface away from the lower surface towards the upper surface, wherein the first end of the upper surface is coupled to the slidable attachment means, wherein the table apron is coupled to the slidable attachment means above the lower surface, and wherein the upper surface adjusts about the slidable attachment means between an open position and a closed position. In an aspect of such an embodiment, the table further comprises at least one upper surface support means connected to the upper surface. In an aspect of such an embodiment, the upper surface adjusts about the slidable attachment means between an open position and a closed position. In an aspect of such an embodiment, when the table is in the closed position, the lower surface is concealed by the upper surface. In an aspect of such an embodiment, when the table is in the open position, the lower surface is exposed. In an aspect of such an embodiment, the lower surface comprises a gaming surface. In an aspect of such an embodiment wherein the gaming surface comprises a surface for playing shuffleboard, table pool, card games, or board games, to name just a few non-limiting examples.

Other embodiments are also disclosed.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
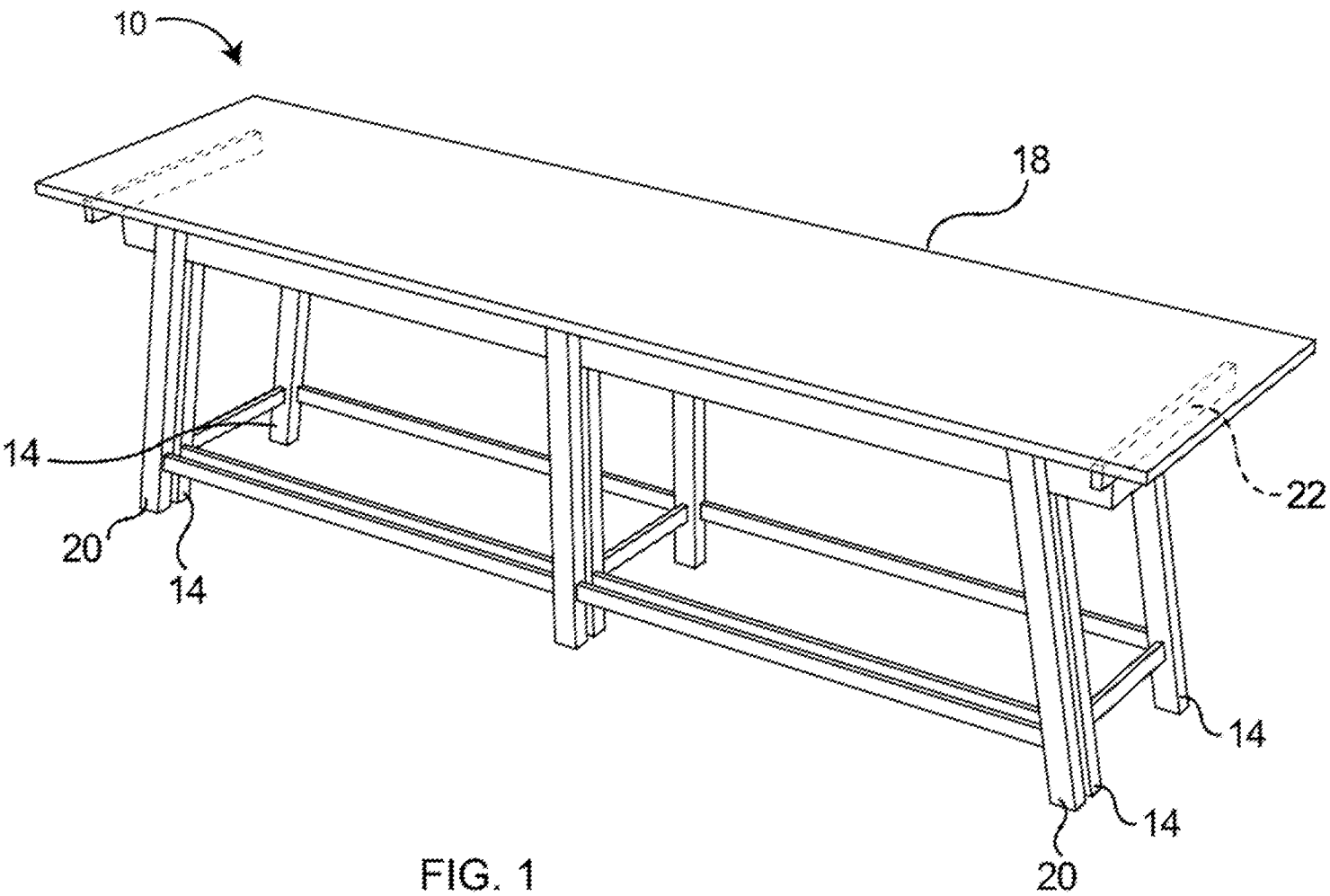
FIG. 1 shows a perspective view of a table in the open position according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows a perspective view of a table 10 in an open position according to at least one embodiment of the present disclosure. The table 10 includes an upper surface 18 with at least an upper surface first end 24 and an upper surface second end 26. The table 10 also includes a lower surface 16. According to an embodiment, the lower surface 16 includes an outer edge 32 and a table apron 22 which includes at least a table apron first end 28 and a table apron second end 30. The table apron 22 extends vertically away from the lower surface 16 toward the upper surface 18 when the table 10 is in the closed position shown in FIG. 2. In other embodiments, there is no table apron 22. The lower surface 16 is supported by at least one table support 14, such as at least one leg, to name just one non-limiting example. According to an embodiment, the at least one table support 14 is connected directly to the lower surface 16. According to an embodiment, the at least one table support 14 is connected directly to table apron 22. The lower surface 16 also includes one or more attachment means 12 operative to attach the lower surface 16 to the upper surface 18.

As shown in FIG. 1, a first attachment means 12 connects to the table apron 22 at the table apron first end 28. A second attachment means 12 connects to the table apron 22 at the table apron second end 30. According to another embodiment, the attachment means 12 connects to the lower surface 16. The table 10 also includes an upper surface 18. The upper surface 18 contains an upper surface first end 24 and an upper surface second end 26. The upper surface 18 is supported by at least one upper surface support 20. According to an embodiment, the at least one upper surface support 20 is connected directly to the upper surface 18. According to an embodiment, the first attachment means 12 is coupled to the upper surface 18 at the end 24, and the second attachment means 12 is couple to the upper surface 18 at the end 26, thereby connecting the upper surface 18 to the lower surface 16.

According to at least one embodiment of the present disclosure, the table 10 contains only one table support 14. According to at least one embodiment of the present disclosure, the table 10 contains two or more table supports 14. According to at least one embodiment of the present disclosure, the table 10 contains only one upper surface support 20. According to at least one embodiment of the present disclosure, the table 10 contains two or more upper surface supports 20.

Figure 2:
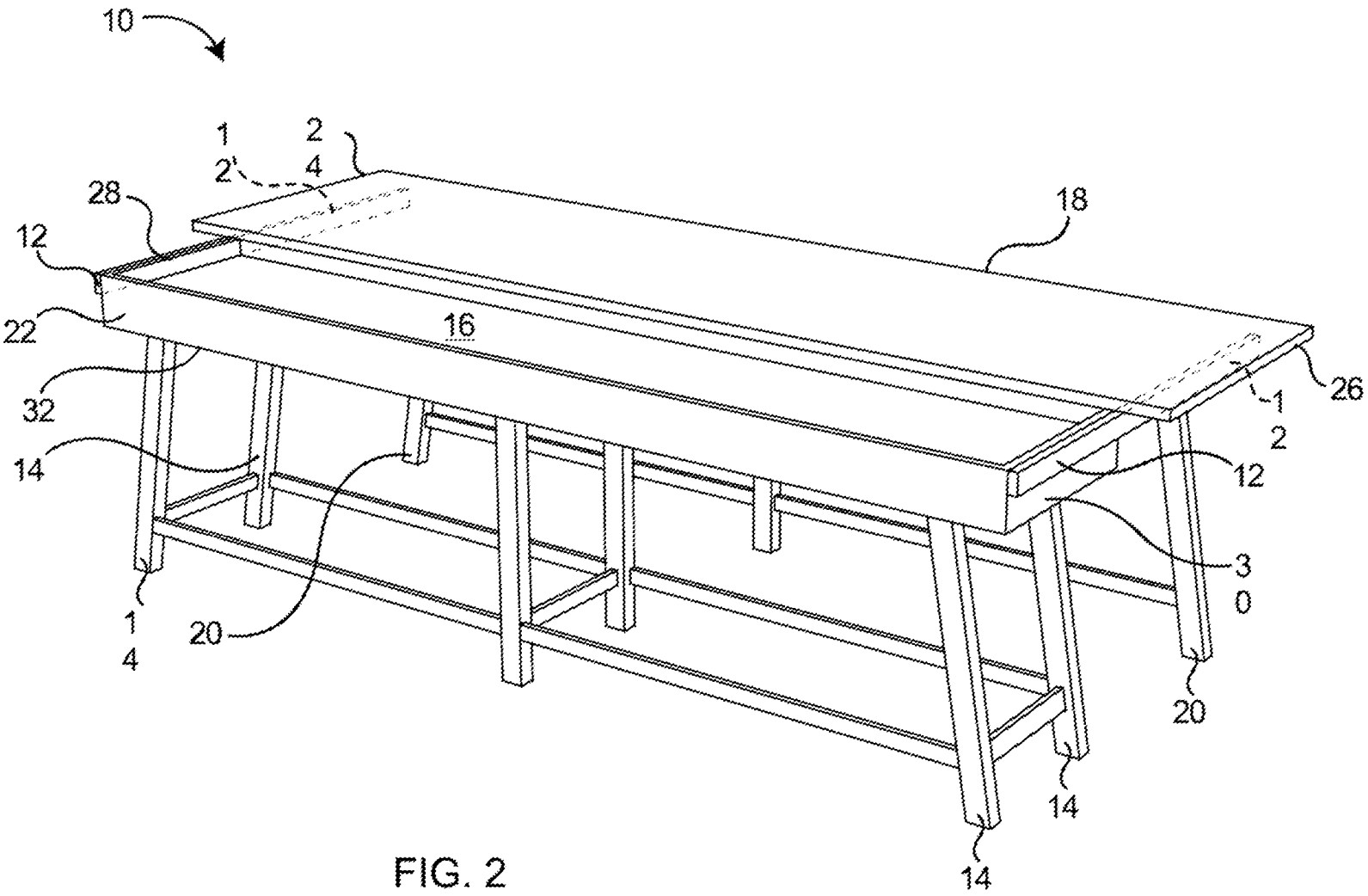
FIG. 2 shows a perspective view of a table in the closed position according to at least one embodiment of the present disclosure.
Figure 4:
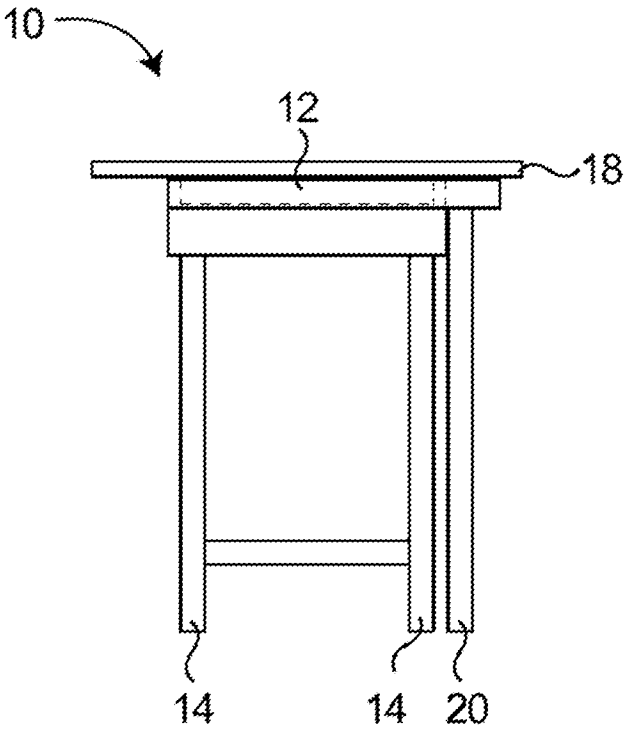
FIG. 4 shows an end view of a table in the closed position according to at least one embodiment of the present disclosure.
Figure 5:
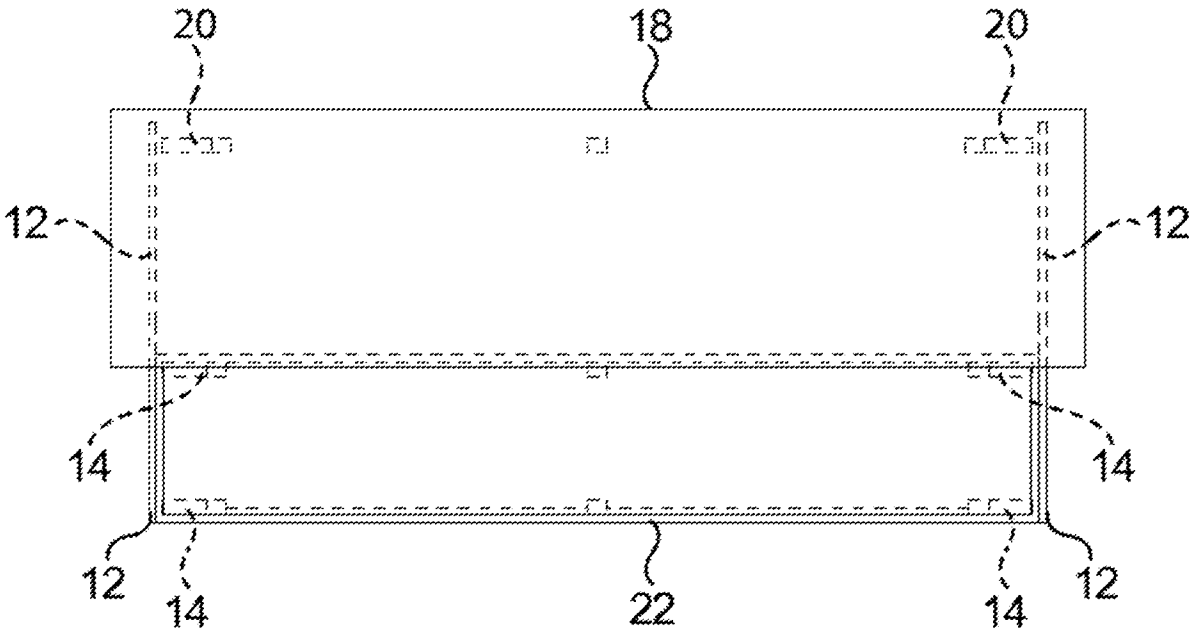
FIG. 5 shows a bottom view of a table in the open position according to at least one embodiment of the present disclosure.
Figure 6:
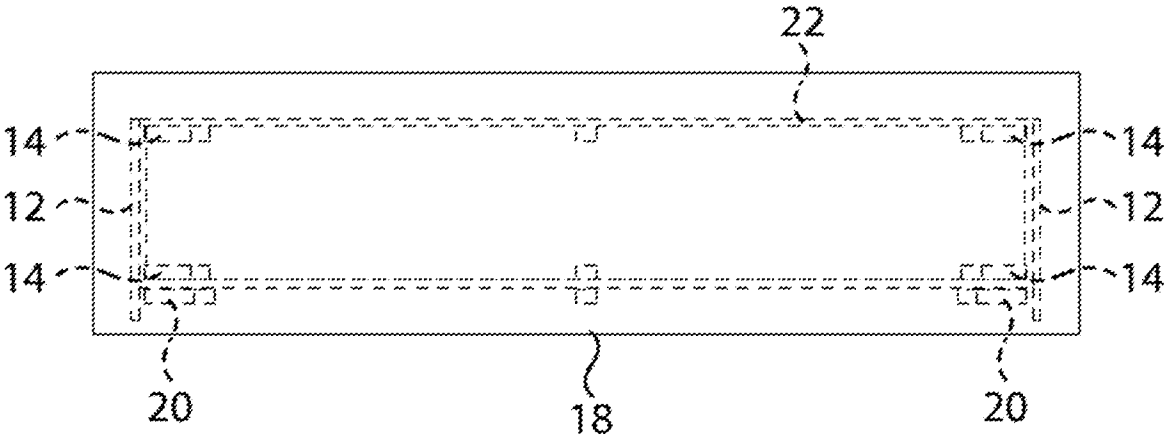
FIG. 6 shows a bottom view of a table in the closed position according to at least one embodiment of the present disclosure.
Figure 7:
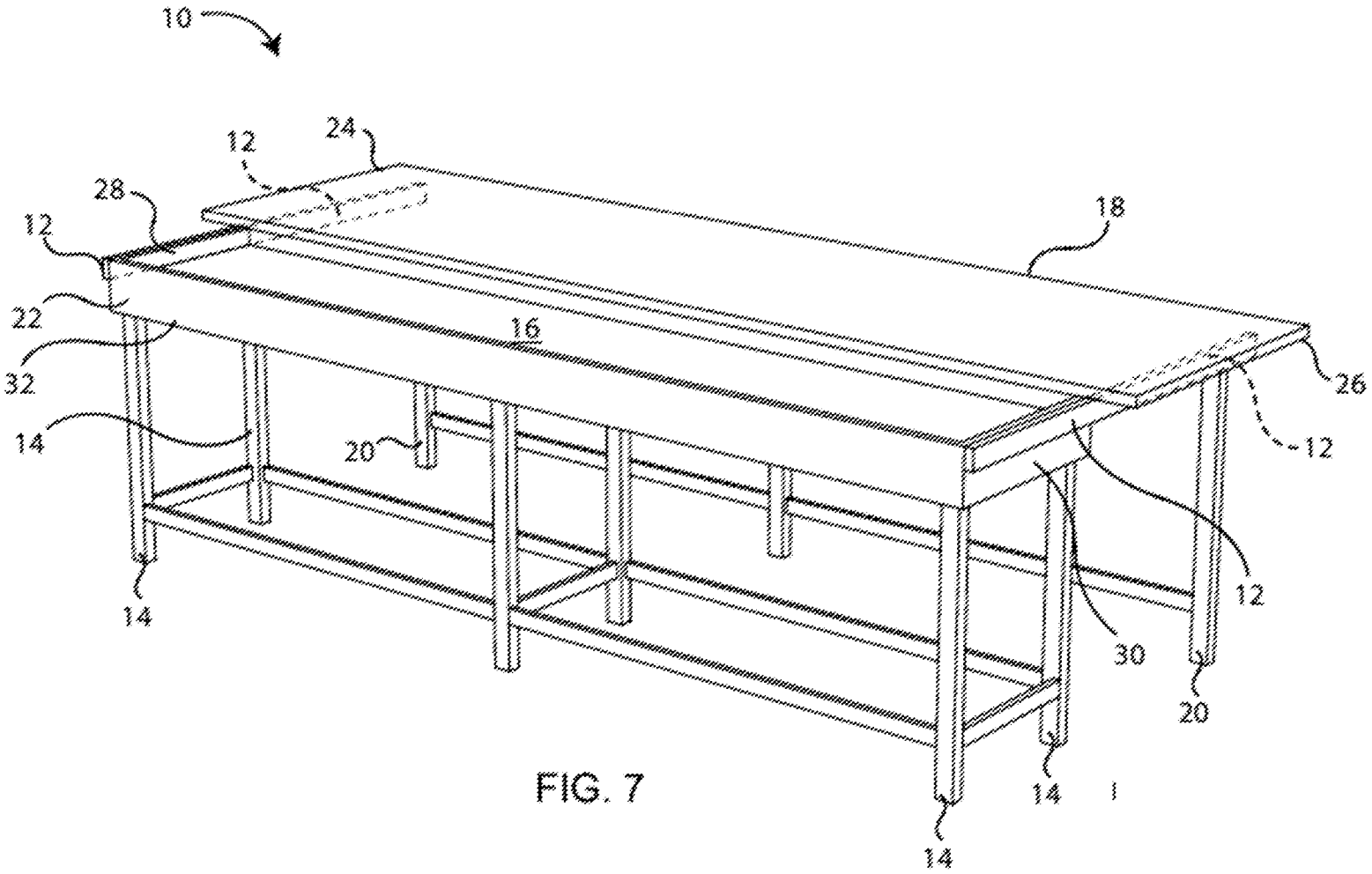
FIG. 7 shows a perspective view of a table in the open position according to at least one embodiment of the present disclosure.
Figure 8:
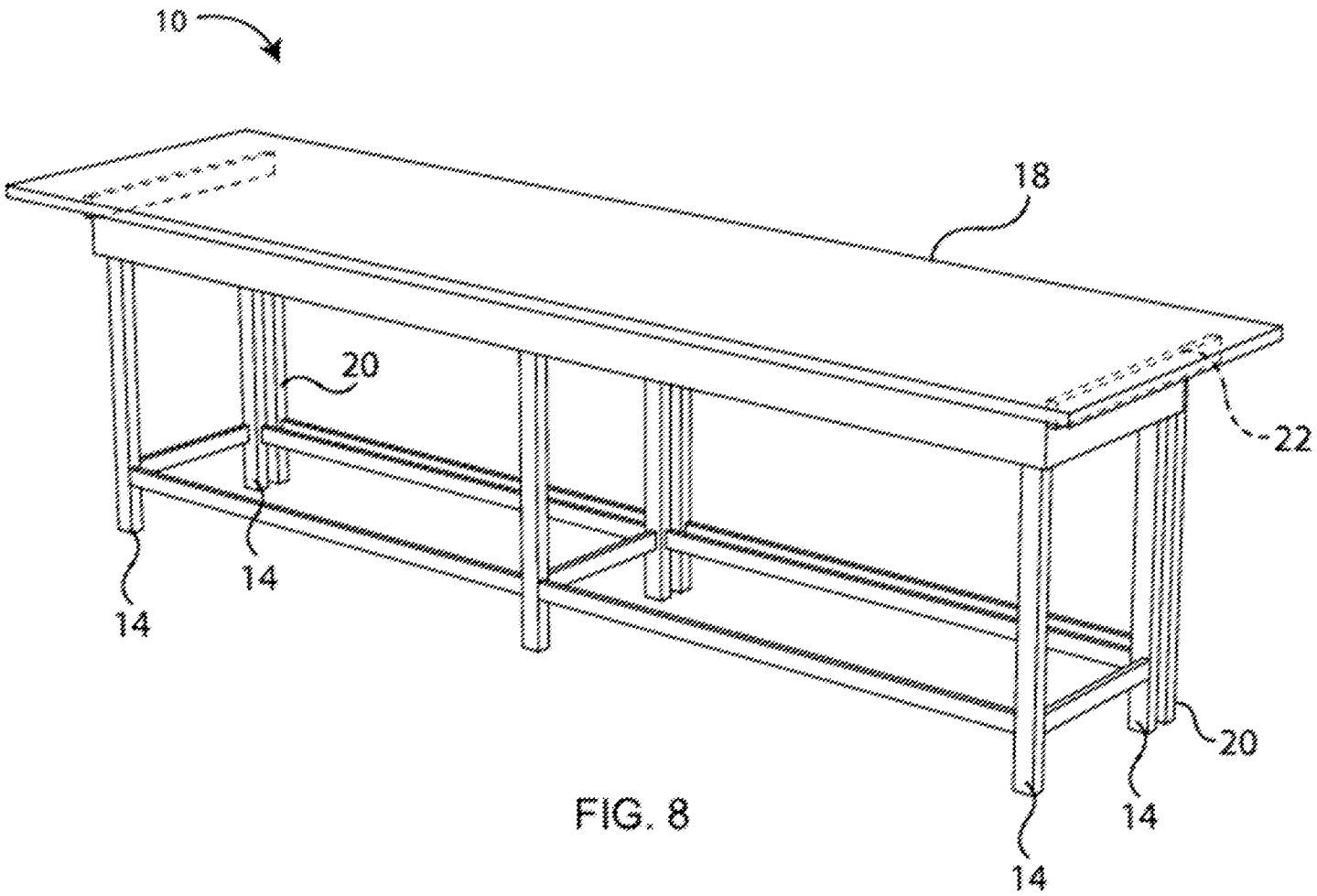
FIG. 8 shows a perspective view of a table in the closed position according to at least one embodiment of the present disclosure.
Figure 10:
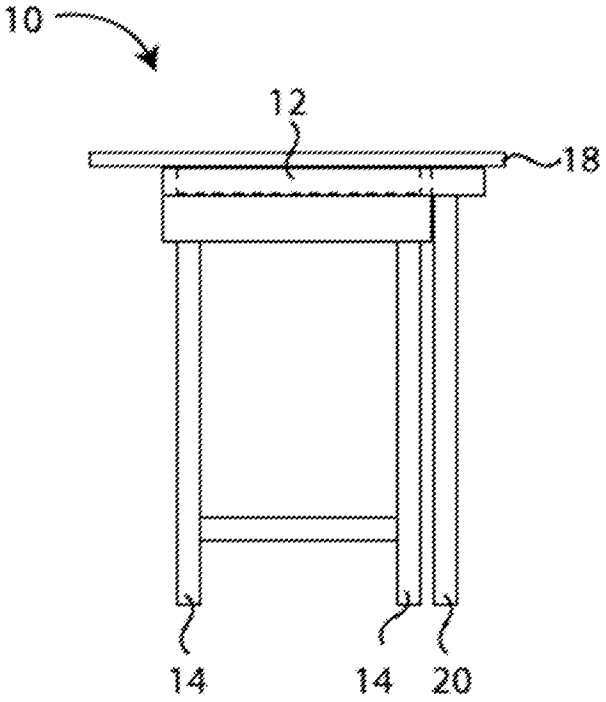
FIG. 10 shows an end view of a table in the closed position according to at least one embodiment of the present disclosure.
Figure 9:
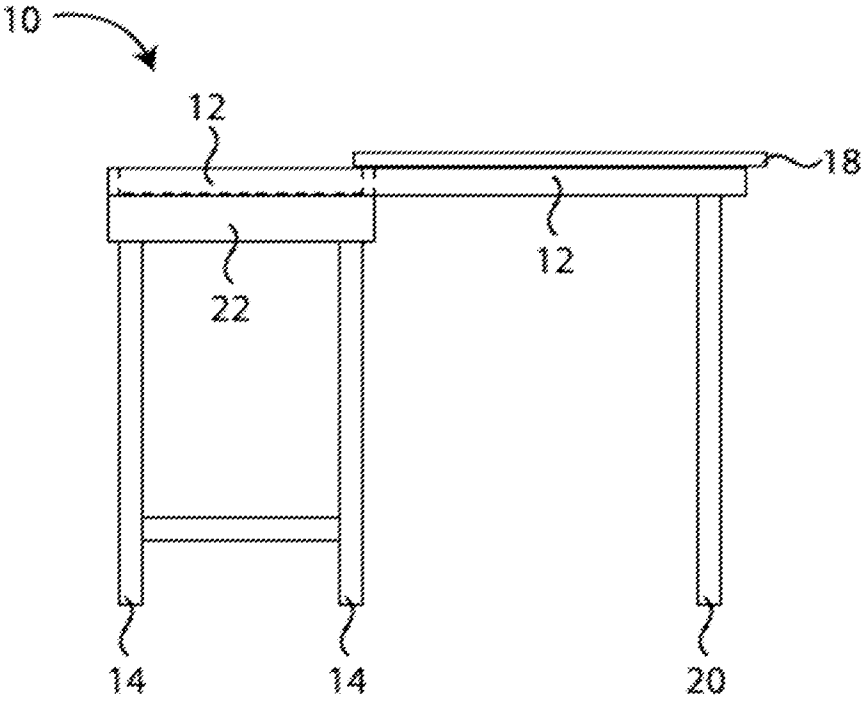
FIG. 9 shows an end view of a table in the open position according to at least one embodiment of the present disclosure.
Figure 11:
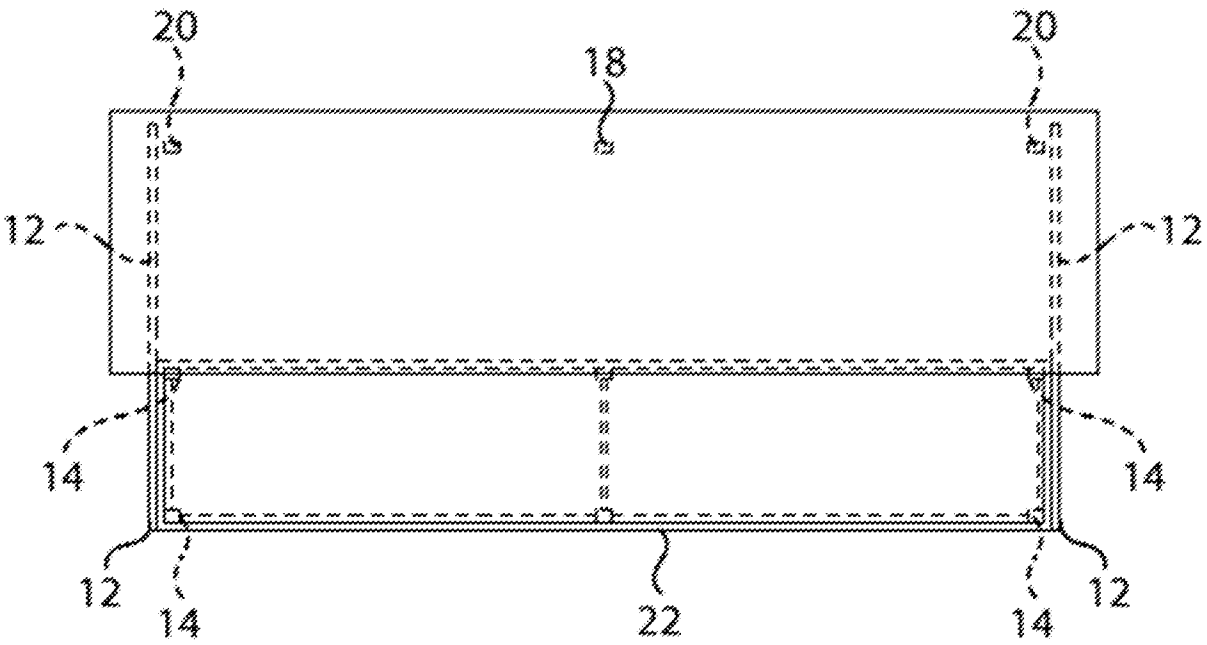
FIG. 11 shows a bottom view of a table in the open position according to at least one embodiment of the present disclosure.
Figure 12:
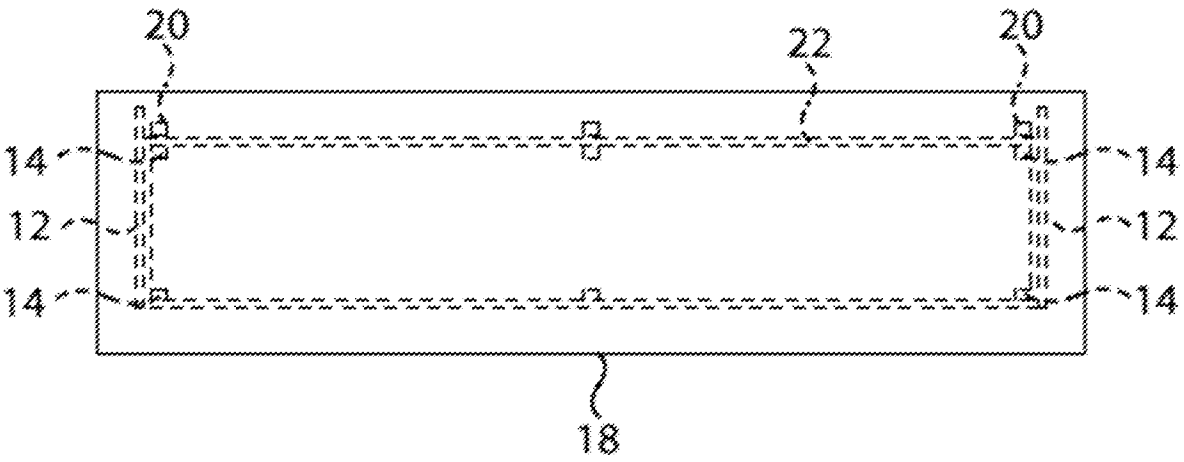
FIG. 12 shows a bottom view of a table in the closed position according to at least one embodiment of the present disclosure.
Figure 13:
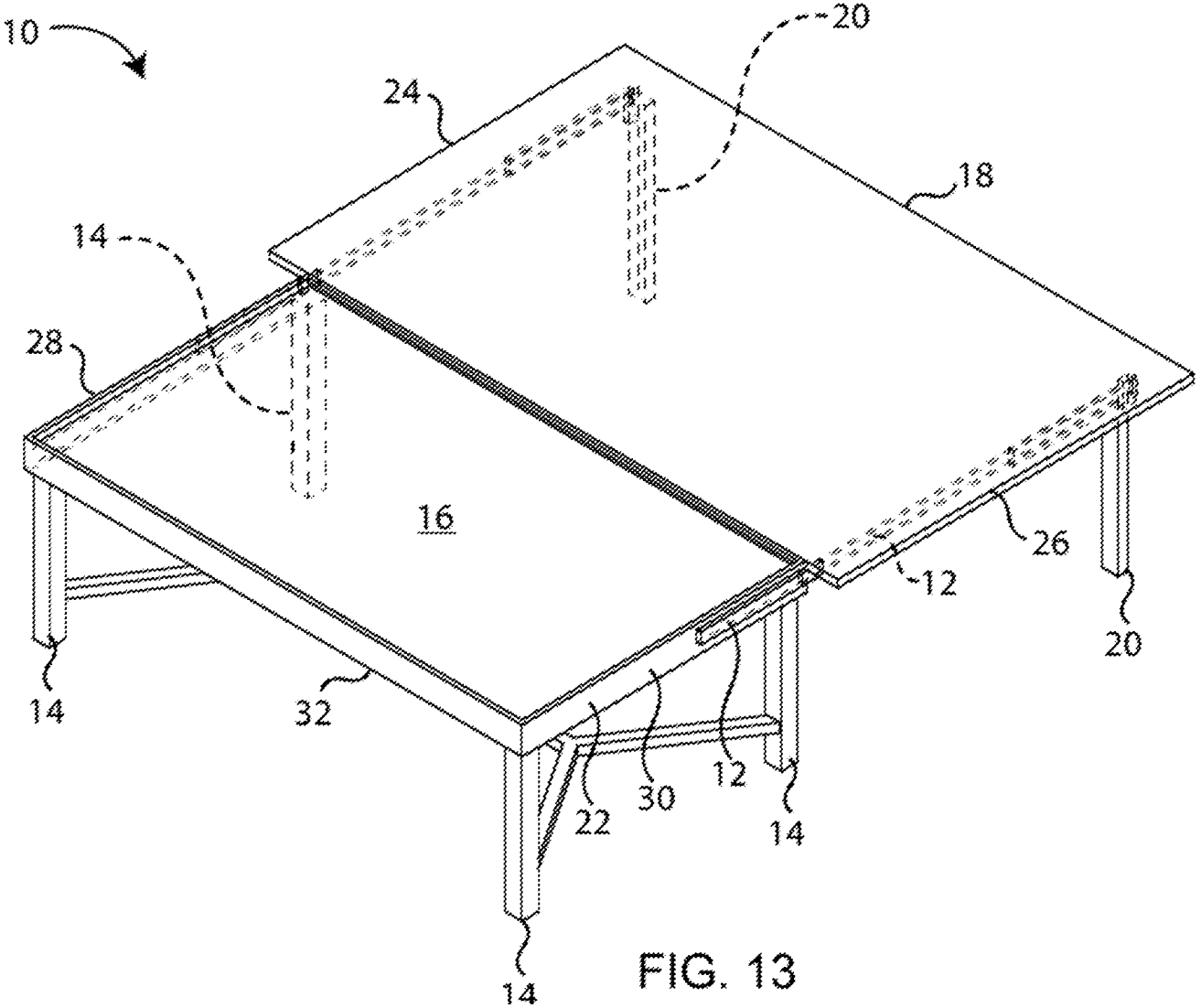
FIG. 13 shows a perspective view of a table in the open position according to at least one embodiment of the present disclosure.
Figure 14:
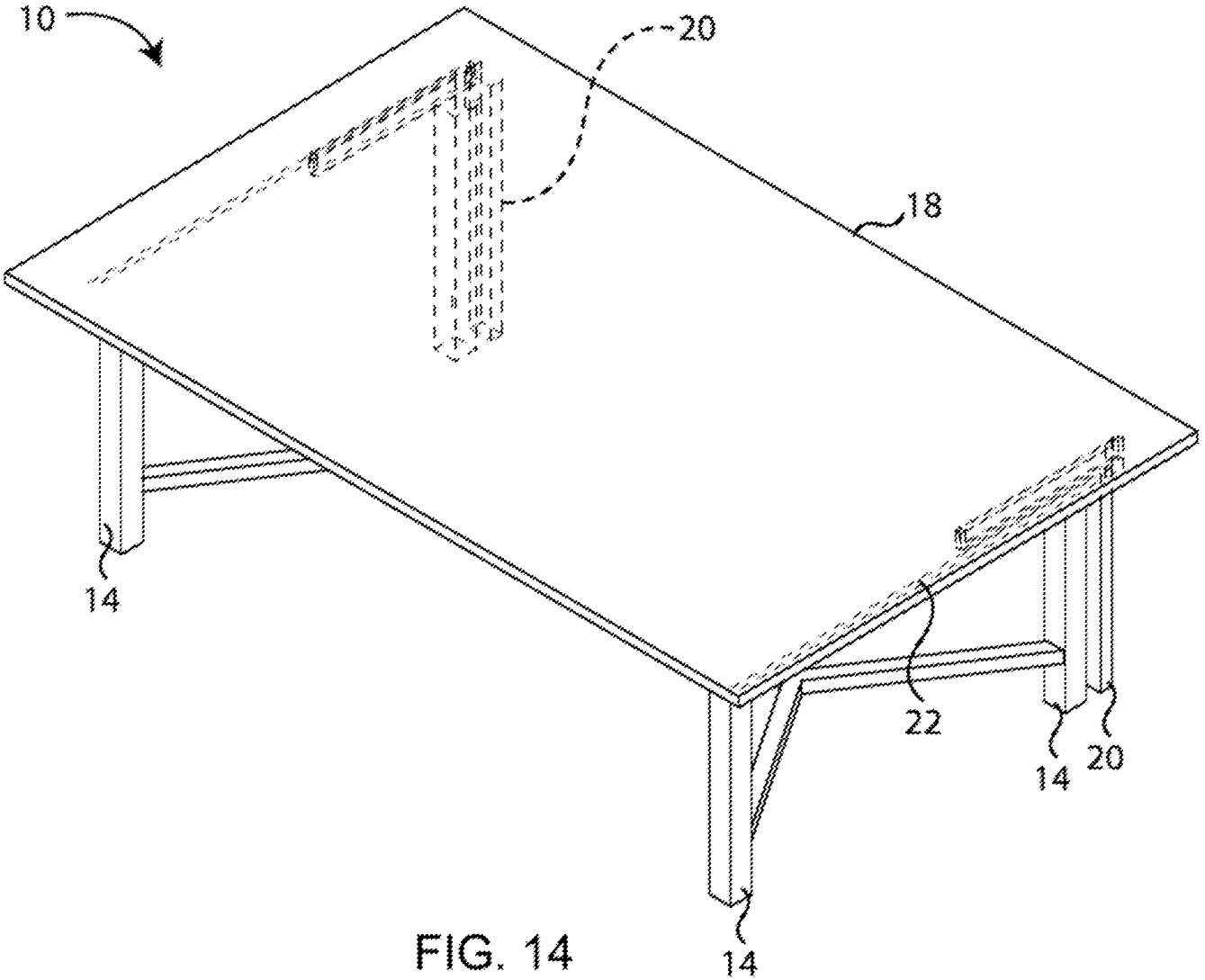
FIG. 14 shows a perspective view of a table in the closed position according to at least one embodiment of the present disclosure.
Figure 16:
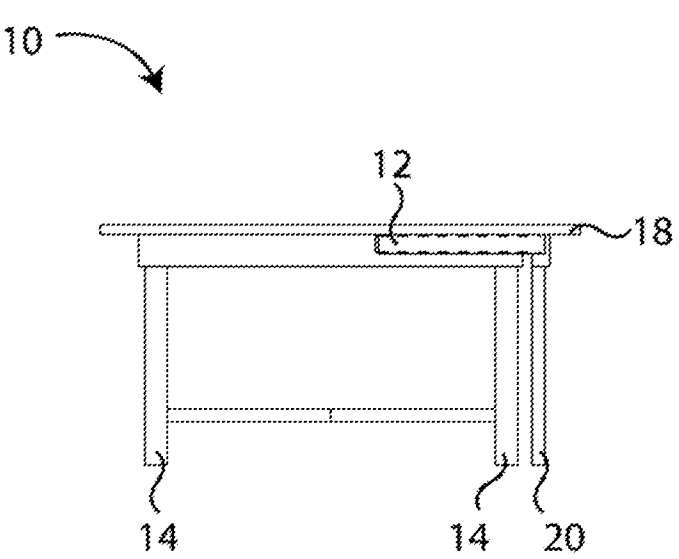
FIG. 16 shows an end view of a table in the closed position according to at least one embodiment of the present disclosure.
Figure 15:
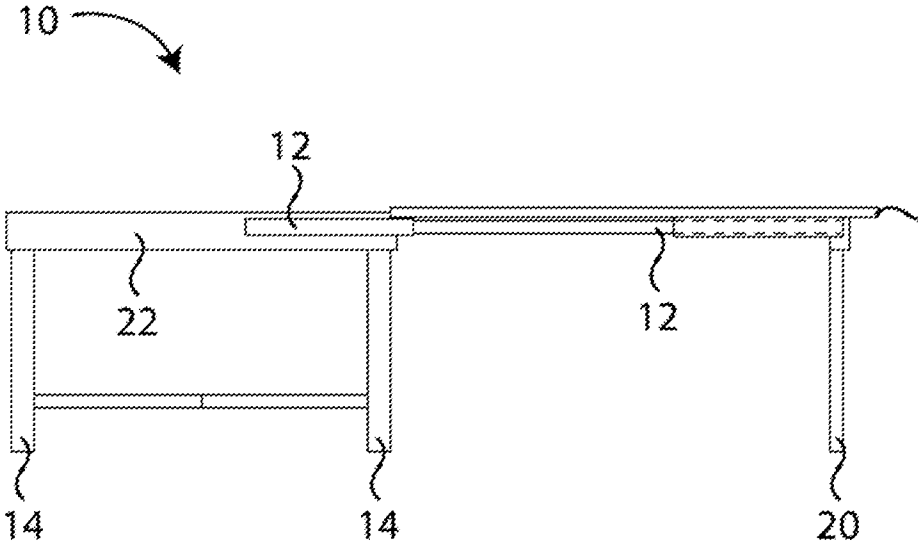
FIG. 15 shows an end view of a table in the open position according to at least one embodiment of the present disclosure.
Figure 18:
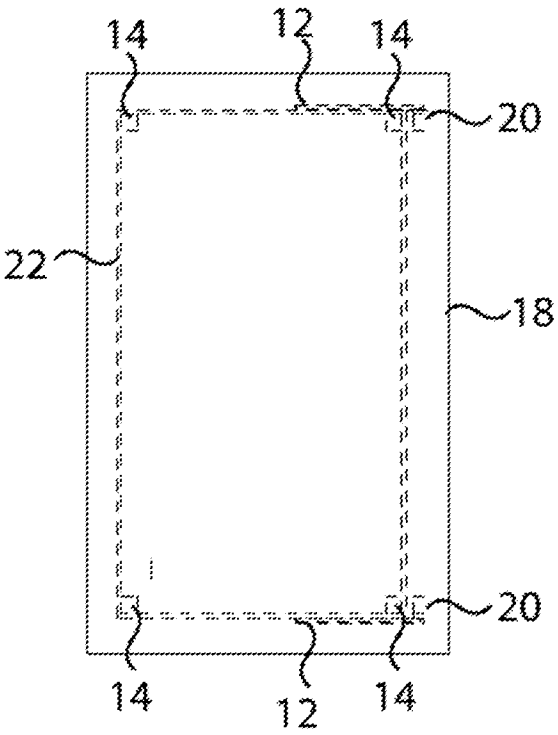
FIG. 18 shows a bottom view of a table in the closed position according to at least one embodiment of the present disclosure.
Figure 17:
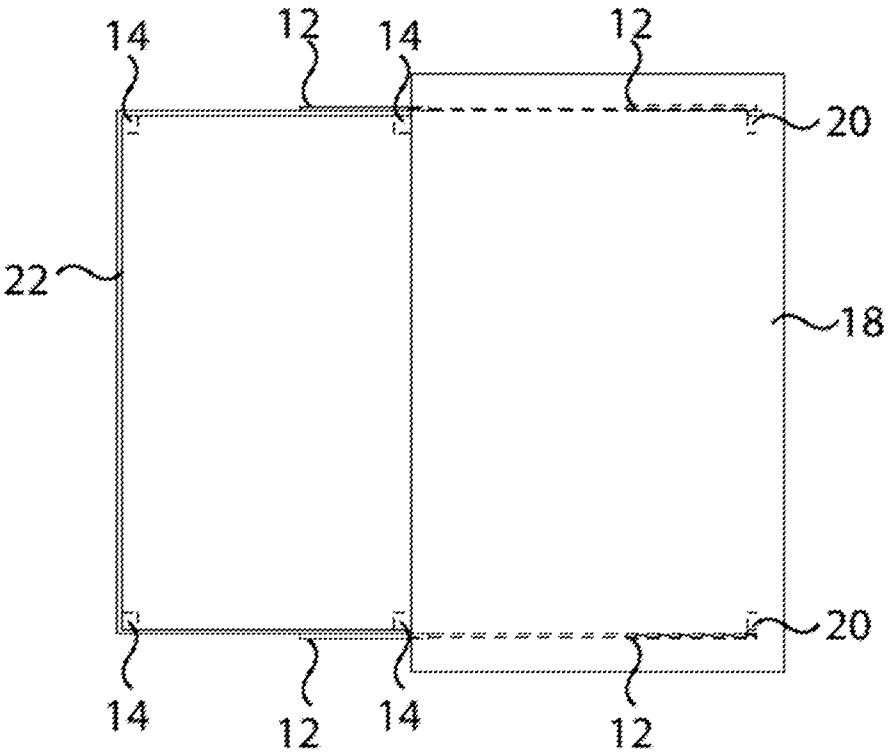
FIG. 17 shows a bottom view of a table in the open position according to at least one embodiment of the present disclosure.

According to at least one embodiment of the present disclosure, the attachment means 12 are a slidable attachment means allowing the upper surface 18 to slide freely between an open position (shown in FIGS. 1, 3 and 5) and a closed position (shown in FIGS. 2, 4 and 6). When the table is in the open position, as in FIG. 1, the lower surface 16 is visible from above. When the table is in the closed position, as in FIG. 2, the lower surface 16 is not visible form above as it is concealed by the upper surface 18. It will be appreciated by one of skill in the art that the attachment means 12 may be any suitable attachment means allowing for the free movement of the upper surface 18 from the lower surface 16, such as a conventional drawer slide.

According to at least one embodiment of the present disclosure, when the table 10 is in the open position, the lower surface 16 is visible to a user above the table 10. According to an embodiment, the lower surface 16 is a gaming surface, to name just one non-limiting example. In various embodiments, the gaming surface is a shuffleboard surface, table pool surface, card game surface, or a board game surface, to name just a few non-limiting examples. In other embodiments, the lower surface 16 is not designed for a particular purpose, but merely provides additional deployable table space when in the open position.

FIG. 2 shows a perspective view of a table 10 in the closed position according to at least one embodiment of the present disclosure. According to this embodiment, the lower surface 16 is concealed by the upper surface 18. The attachment means 12 are also concealed under the upper surface 18. According to an embodiment, the at least one upper surface support 20 moves with the upper surface 18 into the closed position.

Figure 3:
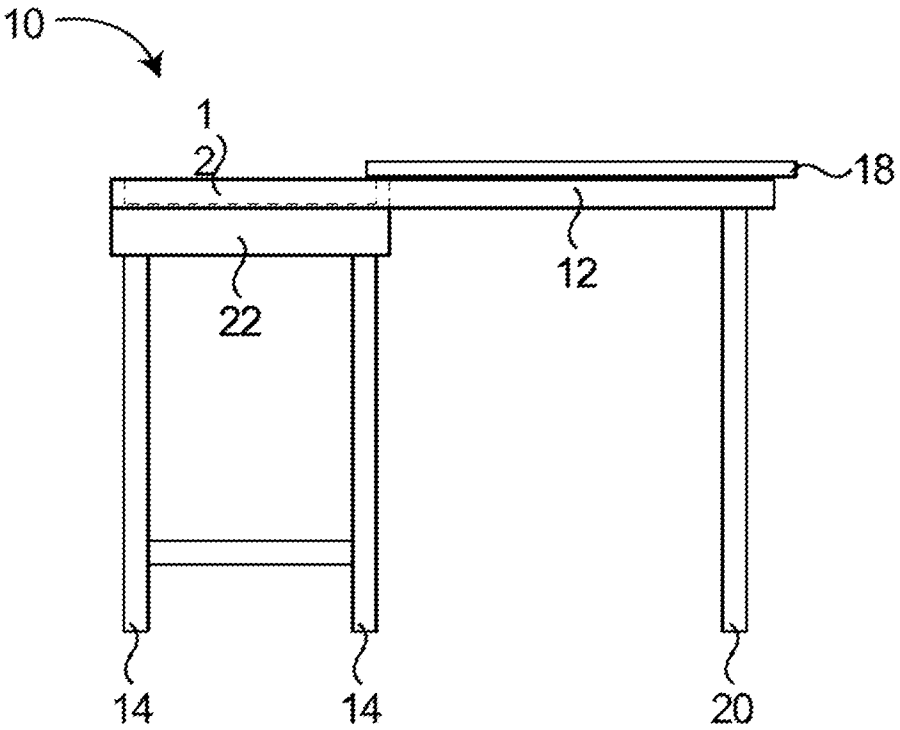
FIG. 3 shows an end view of a table in the open position according to at least one embodiment of the present disclosure.

FIG. 3 shows an end view of a table 10 in the open position according to at least one embodiment of the present disclosure. According to this embodiment, the upper surface 18 and the upper surface support 20 are moved away from the lower surface 16 via the attachment means 12, thereby revealing the lower surface 16 to a user above the table 10. The at least one table support means 14 supports the lower surface 16 and the table apron 22 while the at least one upper surface support 20 continues to support the upper surface 18 while in the open position.

FIG. 4 shows an end view of a table in the closed position according to at least one embodiment of the present disclosure. According to this embodiment, the upper surface 18 is moved via the attachment means 12 (not shown) to cover the lower surface 16 (not shown) to sit atop the table apron 22.

FIG. 5 shows a bottom view of a table 10 in the open position according to at least one embodiment of the present disclosure. According to an embodiment of the present disclosure, the attachment means 12 is visible connecting the upper surface 18 to the lower surface 16 and/or table apron 22. Also visible are the table supports 14 and the upper surface supports 20.

FIG. 6 shows a bottom view of a table 10 in the closed position according to at least one embodiment of the present disclosure. According to this embodiment, the upper surface 18 is moved via the attachment means 12 to cover the lower surface 16 to sit atop the table apron 22. In this embodiment, the upper surface support 20 contacts the table apron 22.

FIGS. 7-12 illustrate a second embodiment of the table 10 as described herein.

FIGS. 13-18 illustrate a third embodiment of the table 10 as described herein.

While this disclosure has been described as having various embodiments, these embodiments according to the present disclosure can be further modified within the scope and spirit of this disclosure. This application is therefore intended to cover any variations, uses, or adaptations of the disclosure using its general principles. For example, any methods disclosed herein represent one possible sequence of performing the steps thereof. A practitioner may determine in an implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

What is claimed is:

1. A table comprising:

an upper surface comprising a first end;

a lower surface bounded by an outer edge, surrounding the lower surface;

a table apron comprising a first end;

a table support means connected to the lower surface; and a slidable attachment means comprising a slidable attachment means first portion and a slidable attachment means second portion slidably coupled to the slidable attachment means first portion;

wherein the table apron extends from the outer edge of the lower surface away from the lower surface towards the upper surface;

wherein the table apron is coupled to the slidable attachment means first portion; and wherein the first end of the upper surface is non-slidably coupled to the slidable attachment means second portion.

2. The table of claim 1, further comprising an upper surface support means connected to the upper surface.

3. The table of claim 1 wherein the slidable attachment means is configured to move between an open position and a closed position.

4. The table of claim 3 wherein when the table is in the closed position, the lower surface is concealed by the upper surface.

5. The table of claim 3 wherein when the table is in the open position, the lower surface is exposed.

6. The table of claim 1 wherein a gaming surface of the lower surface is configured for playing at least one of shuffleboard, table pool, card games, or a set of board games.

7. The table of claim 6 wherein at least the outer edge of the lower surface enables the playing.

8. The table of claim 1, wherein the first end of the upper surface is non-slidably coupled to the slidable attachment means such that, during at least a sliding of the slidable attachment means, the lower surface becomes exposed and the upper surface remains horizontal and available for use.

9. A table comprising an upper surface comprising a first end;

a lower surface bounded by an outer edge, surrounding the lower surface;

a table apron comprising a first end;

at least one table support means connected to the lower surface; and a slidable attachment means comprising a slidable attachment means first portion and a slidable attachment means second portion slidably coupled to the slidable attachment means first portion;

wherein the table apron extends from the outer edge of the lower surface away from the lower surface towards the upper surface;

wherein the first end of the upper surface is non-slidably coupled to the slidable attachment means second portion;

wherein the table apron is coupled to the slidable attachment means first portion; and wherein the slidable attachment means is configured to move between an open position and a closed position.

10. The table of claim 9, further comprising at least one upper surface support means connected to the upper surface.

11. The table of claim 9 wherein when the table is in the closed position, the lower surface is concealed by the upper surface.

12. The table of claim 9 wherein when the table is in the open position, the lower surface is exposed.

13. The table of claim 9 wherein a gaming surface of the lower surface is configured for playing at least one of shuffleboard, table pool, card games, or a set of board games.

14. The table of claim 13 wherein at least the outer edge of the lower surface enables the playing.

15. The table of claim 9, wherein the first end of the upper surface is non-slidably coupled to the slidable attachment means second portion such that, during at least a sliding of the slidable attachment means, the lower surface becomes exposed and the upper surface remains horizontal and available for use.

* * * * *